US006120959A

United States Patent [19]

Sugizaki et al.

[11] Patent Number: 6,120,959

[45] Date of Patent: Sep. 19, 2000

[54] BLACK TONER FOR DEVELOPING ELECTROSTATIC LATENT IMAGE

[75] Inventors: Yutaka Sugizaki; Hirokazu Hamano, both of Minamiashigara, Japan

[73] Assignee: Fuji Xerox Co., Ltd., Tokyo, Japan

[21] Appl. No.: 09/386,375

[22] Filed: Aug. 31, 1999

[30] Foreign Application Priority Data

Oct. 7, 1998 [JP] Japan ..... 10-285706

[51] Int. Cl.[7] ..... G03G 9/00

[52] U.S. Cl. ..... 430/106; 430/45

[58] Field of Search ..... 430/45, 106, 137

[56] References Cited

U.S. PATENT DOCUMENTS

| | | | |
|---|---|---|---|
| 5,273,853 | 12/1993 | Urano et al. | 430/45 |
| 5,869,215 | 2/1999 | Ong et al. | 430/137 |

FOREIGN PATENT DOCUMENTS

| | | |
|---|---|---|
| 63-13057 | 1/1988 | Japan . |
| 63-13058 | 1/1988 | Japan . |
| 63-170659 | 7/1988 | Japan . |
| 63-301962 | 12/1988 | Japan . |
| 1-254968 | 10/1989 | Japan . |
| 2-293860 | 12/1990 | Japan . |
| 4-242752 | 8/1992 | Japan . |
| 4-356059 | 12/1992 | Japan . |

*Primary Examiner*—John Goodrow
*Attorney, Agent, or Firm*—Oliff & Berridge, PLC

[57] ABSTRACT

A black toner for developing electrostatic latent images having colored particles and external additive(s) and the colored particles containing at least a binder resin, carbon black, a cyan pigment, a magenta pigment, and a yellow pigment.

The concentration ($C_{CB}$ weight %) of carbon black, the concentration ($C_C$ weight %) of the cyan pigment, the concentration ($C_M$ weight %) of the magenta pigment, and the concentration ($C_Y$ weight %) of the yellow pigment in the colored particles preferably satisfy the following relationship (1);

$$C_{CB} \geqq C_M \geqq C_C \geqq C_Y \quad (1).$$

The black toner has the charging property, etc., suitable for forming black images and a high black density without showing color rendering.

13 Claims, 1 Drawing Sheet

BLACK TONER FOR DEVELOPING ELECTROSTATIC LATENT IMAGE

FIELD OF THE INVENTION

The present invention relates to a black toner used for developing electrostatic latent images in an electrophotographic method, an electrostatic recording method, an electrostatic printing method, etc.

BACKGROUND OF THE INVENTION

In an electrophotographic method, an image is generally formed through a step of developing an electrostatic latent image formed on a photoreceptor by attaching thereto a toner, a step of transferring the toner image onto a paper or a plastic film as a transfer material, and a step of fixing the transferred toner image to the transfer material by heating, etc. As a developer used for the electrophotographic method, there are a two-component developer comprising a toner and a carrier, a non-magnetic one-component developer comprising a toner only, and a magnetic one-component developer comprising a toner only. The two-component developer has a feature that the controllability is good, etc., because the carrier made of magnetic particles takes partial functions of charging the toner and transporting the toner, and has been widely used at present.

On the other hand, in a printer and a copying machine using an electrophotographic method, because of the progress of color copying and the improvement of the resolving power of the apparatus, the formation of a precise electrostatic latent image has been carried out. With the tendency, as a toner capable of faithfully developing the precise electrostatic latent image and forming an image of a higher image quality, a small particle size toner has been given attention recently. Particularly, in a full-color copying machine of developing a digital latent image with colored toners, and transferring and fixing the developed image, a high image quality to a certain extent has been attained by employing small particle toners of from 7 to 8 $\mu$m, but in order to meet the requirement of further improvement of the high resolving power (the improvement of the fine-line reproducibility, the improvement of the gradation reproducibility, etc.), it becomes necessary to make the toner further small-sizing and also to make the particle size distribution of the toner an appropriate range.

However, when the particle size of toner is more reduced, a non-electrostatic attaching force typified by a van der Waals force is increased and the cohesive force of toner particles to each other is increased. Thereby, there is a tendency of reducing the powder fluidity of the toner and increasing the attaching force of tone to the carrier surface and the surface of photoreceptor, and as the result thereof, the developing property and the transferring property of the toner are reduced, the image density is lowered, and the cleaning property of the toner remaining on the surface of the photoreceptor is greatly lowered. Accordingly, it is the actual circumstances that the formation of the image having a high image quality by using a small-sized toner of 6 $\mu$m or smaller has not yet attained.

Now, by using a small-sized toner, the image quality is improved by that the fine-line reproducibility and the gradation reproducibility are improved, and also the small-sized toner can contribute that improvement of the image quality in the point of reducing the toner weight of the imaged region. Hitherto, the toner layer of the imaged region becomes thick (particularly remarkable in color images) and in the case of fixing the image by a fixing roller, etc., a luster unevenness occurs in the imaged portions and the non-imaged portions, which substantially lowers the image quality. Thus, if the toner can be small-sized, the toner layer of the imaged region can be thinned and the occurrence of the luster unevenness can be restrained.

On the other hand, even when the toner weight of the imaged region is reduced by small-sizing the toner, of the colored density of the toner per unit weight thereof is same as that of a conventional toner, as the result thereof, the image density is lowered. As a method of preventing lowering of the image density, there is a method of increasing the concentration of the pigment contained in the toner. However, when the concentration of carbon black mainly used as the pigment of a black toner is increased, it gives an influence on the charging property of the toner. As the result thereof, it sometimes happens that a charging inferiority of the toner occurs and a charge is injected in the toner at development to form a fog on the image.

As a method of producing a black toner, there is a method of coloring a black color by mixing three kinds of pigments other than carbon black, such as, cyan, magenta, and yellow pigments. According to this method, because carbon black giving an influence on the charging property of a toner is not used, when the concentrations of the pigments in the toner are increased, the occurrence of the fogging phenomenon of image with the charging inferiority of the toner can be prevented. However, when these three kinds of the pigments are mixed to color a black color, there is a so-called color rendering wherein the black color is viewed as a different color according to the wavelength of the irradiating light and thus there is a problem that the viewing color is changed between under the sun light and under a light of a fluorescent lamp, etc., in room. Also, when the concentrations of the pigments in the toner are increased, it sometime happens that the properties of the toner such as the molten viscosity, etc., are changed, which causes lowering of the image quality in a fixing step.

Furthermore, in the toner of prior art, even when the addition amount of a coloring agent such as carbon black, etc., is increased, the graininess (rough viewing of the highlight portion) is deteriorated, whereby there is a problem that the image quality is rather lowered.

SUMMARY OF THE INVENTION

The present invention has been made in view of the above-described problems and an object of the present invention is to provide a toner having the charging property and physical properties suitable for the formation of images and also having a black color density. Also, another object of this invention is to provide a black toner having a high black color density and showing no color rendering.

As the result of making various investigations for solving the above-described problems, the present inventors have found that by incorporating a cyan pigment, a magenta pigment, and a yellow pigment in a toner together with carbon black, a black toner having a high black color density and causing no image fog at the image formation, and have accomplished the present invention.

That is, the invention is a black toner for developing electrostatic latent images comprising colored particles and external additive(s), the colored particles containing at least a binder resin, carbon black, a cyan pigment, a magenta pigment, and a yellow pigment. In this invention, it is preferred that the concentration of carbon black ($C_{CB}$ weight %) the concentration of the cyan pigment ($C_C$ weight %), the concentration of the magenta pigment ($C_M$ weight %), and the concentration of the yellow pigment ($C_Y$ weight %) in the colored particles satisfy the following relationship (1);

$$C_{CB} \geqq C_M \geqq C_C \geqq C_Y \quad (1)$$

Also, it is preferred that the concentration of carbon black in the colored particles is 2% by weight or higher but not higher than 10% by weight. Furthermore, it is preferred that the magenta pigment, the cyan pigment, and the yellow pigment are contained in the colored particles as the dispersed particles and the mean dispersed particle size of the dispersed particles is not larger than 0.3 μm as the circle-equivalent diameter.

Also, it is preferred that the volume mean particle size of the colored particles is from 1.0 to 5.0 μm, the ratio of the colored particles having the particle sizes of 1.0 μm or shorter is 20% or less and the ratio of the colored particles having the particle sizes exceeding 5.0 μm is 10% or less, because in this case, the fine-line reproducibility, the gradation reproducibility, etc., are improved and also the image quality is improved.

DETAILED DESCRIPTION OF THE INVENTION

Figure 1:
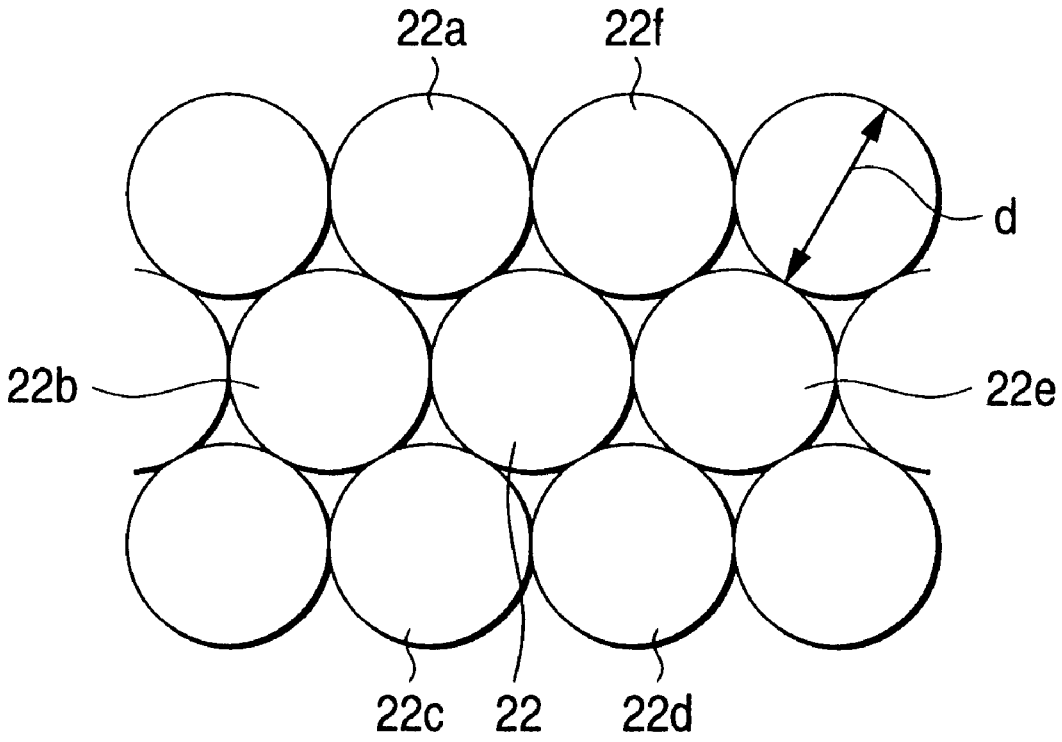
FIG. 1 is an enlarged plane view showing a part of the surface of colored particles.

Then, the invention is described in detail.

The toner of this invention comprises colored particles and external additive(s) and it is the feature of this invention that the colored particles contain a cyan pigment, a magenta pigment, and a yellow pigment together with carbon black. Then each constituting element is explained.

1. Colored particles 1.1 Carbon black

There is no particular restriction on carbon black used in this invention and the carbon black can be selected from carbon blacks which are hitherto been used. The particle sizes of carbon black are preferably small because the dispersibility of the carbon black in the toner is improved. Practically, it is preferred to use the carbon black having a mean particle size of from 10 to 50 nm.

Also, as the hue of carbon black used in this invention, the hue of furnace black, channel black, acetylene black, etc., is preferred although the hue is not particularly limited to the aforesaid hue.

1.2 Pigment

As the cyan, magenta, and yellow pigments (hereinafter, they are sometimes referred to as "C pigment", "M pigment", and "Y pigment" respectively) they can be selected from the pigments which are hitherto been known. As the C pigment, C.I. Pigment Blues 15, 15:2, 15:3, etc., are suitably used. As the M pigment, C.I. Pigment Reds 48:1, 48:2, 48:3, 53:1, 51:1, 112, 122, 123, 144, 149, 166, 177, 178, 221, etc., are preferably used. Also, as the Y pigment, C.I. Pigment Yellows 12, 14, 17, 97, 180, 188, etc., are preferably used.

The transparency of the colored particles and the coloring power of the coloring agents are determined by the dispersed state of the C pigment, M pigment and the Y pigment in the colored particles. When the dispersed particle sizes of the pigments are too large, the coloring power and the transparency are lowered. Practically, it is preferred that pigment particles are dispersed in the binder resin in the state that the dispersed particle mean particle size is not larger than 0.3 μm as the circle-equivalent diameter so that the coloring powers of the pigment particles become the maximum.

In addition, the above-described circle-equivalent diameter is the value obtained by sampling a part of the pigment particles, after embedding the sample in a resin, cutting out a thin piece for observation so that the dispersed state of the pigment particles in the colored particles can be observed, photographing it by a transmission-type electron microscope as an enlarged photograph of 15,000 magnifications, measuring the area of the pigment particle by an image analyzing apparatus, and calculating the diameter of the circle equivalent to the area.

As the method of dispersing the pigment particles in the binder resin, for example, the melt flashing method (Japanese Patent Laid-Open No. 242752/1992) proposed by the present inventors can be suitably used. The melt flashing method described above is one of the methods of dispersing pigment particles in a binder resin and is a method wherein about a pigment-containing cake formed in the production process of the pigment, water contained in the cake is replaced with a molten binder resin. According to the method, the dispersed particle mean particle size of the pigment particles in the binder resin can be reduced to 0.3 μm or lower as the circle-equivalent diameter. Also, by the melt flashing method, the coloring power of the pigments is improved, whereby the concentrations of the C, M, and Y pigments in the toner can be preferably lowered.

1.3 Concentrations of carbon black and C, M, and Y pigments

When the concentration of carbon black ($C_{CB}$ weight %), the concentration of the cyan pigment ($C_{CC}$ weight %), the concentration of the magenta pigment ($C_M$ weight %), and the concentration of the yellow pigment ($C_Y$ weight %) in the colored particles satisfy the following relationship (1), the black color density of the toner can be preferably effectively increased while restraining the occurrence of color rendering.

$$C_{CB} \geqq C_M \geqq C_C \geqq C_Y \quad (1)$$

When the concentration of carbon black in the colored particles is increased, the charging property is lowered and as the result thereof, there is a tendency of forming an image fog. The concentration of carbon black is preferably 10% by weight or lower because in this case, deviation of the charging property of the toner can be effectively restrained. The concentration of carbon black is particularly preferably 8% by weight or lower. On the other hand, when the addition amount of the C, M, and Y pigments is increased, it sometimes happens that the melt viscosity of the toner is increased, which causes lowering the fixing property of the toner in the fixing step, etc. Also, when the amount of carbon black is less, it is necessary to use large amounts of the C, M, and Y pigments but because when the concentrations of the pigments are increased, color rendering by these pigments appears, the amount of carbon black used is preferably at least 2% by weight, and more preferably at least 3% by weight. Accordingly, when the amount of carbon black is in the above-described range and the concentrations of the C, M, and Y pigments satisfy the above-described relationship (1), lowering of the fixing property by the increase of the melt viscosity of the toner can be prevented and the occurrence of color rendering can be restrained.

1.4 Binder resin

About the binder resin contained in the colored particles, the glass transition point is preferably from 50 to 80° C., and more preferably from 55 to 75° C. If the glass transition point is lower than 50° C., the thermal retentively is lowered, while if it exceeds 80° C., the low-temperature fixing property is lowered, which are undesirable.

Also, the softening point of the binder resin is preferably from 80 to 150° C., more preferably from 90 to 150° C., and far more preferably from 100 to 140° C. If the softening point is lower than 80° C., the heat preservative property is lowered, while if it exceeds 150° C., the low-temperature fixing property is lowered, which are undesirable.

Furthermore, the number average molecular weight of the binder resin is preferably in the range of from $1.0\times10^3$ to $5.0\times10^4$ and the weight average molecular weight thereof is preferably in the range of from $7.0\times10^3$ to $5.0\times10^5$.

As the binder resin, the resins which have hitherto been used as binder resins of toners can be used without particular restriction and as styrene-based polymers, (meth)acrylic acid ester-based polymers, and styrene-(meth)acrylic acid ester-based polymers, the polymers obtained by polymerizing or copolymerizing one kind or two or more kinds of the monomers selected from styrenic monomers, (meth)acrylic acid monomers, acrylic or methacrylic monomers, vinyl ether monomers, vinyl ketone monomers, N-vinyl compound monomers, etc., described below are suitably used.

Examples of the styrenic monomer include styrene and styrene derivatives such as o-methylstyrene, ethylstyrene, p-methoxystyrene, p-phenylstyrene, 2,4-dimethylstyrene, p-n-octylstyrene, p-n-decylstyrene, p-n-dodecylstyrene, butylstyrene, etc.

Also, examples of the (meth)acrylic acid ester monomer includes (meth)acrylic acid esters such as methyl (meth) acrylate, ethyl (meth)acrylate, propyl (meth)acrylate, butyl (meth)acrylate, isobutyl (meth)acrylate, n-octyl (meth) acrylate, dodecyl (meth)acrylate, 2-ethylhexyl (meth) acrylate, stearyl (meth)acrylate, phenyl (meth)acrylate, dimethylaminoethyl (meth)acrylate, etc.

Examples of the acrylic or methacrylic monomer described above include acrylonitrile, methacrylonitrile, glycidyl methacrylate, N-methylolacrylamide, N-methylolmethacryl-amide, and 2-hydroxyethylacrylamide.

Also, examples of the vinyl ether monomer include vinyl ethers such as vinyl methyl ether, vinyl ethyl ether, vinyl isobutyl ether, etc.

Furthermore, examples of the vinyl ketone monomer include vinyl ketones such as vinyl methyl ketone, vinyl hexyl ketone, methyl isopropenyl ketone, etc.

Also, examples of the N-vinyl compound monomer include N-vinyl compounds such as N-vinylpyrrolidone, N-vinyl carbazole, N-vinylindole, etc.

In the present invention, a polyester is suitably used as the binder resin in the view point of the fixing property. As such a polyester, the polyester synthesized by the polycondensation of a polyhydric carboxylic acid and a polyhydric alcohol can be used.

As the polyhydric alcohol monomer, aliphatic alcohols such as ethylene glycol, propylene glycol, 1,3-butanediol, 1,4-butanediol, 2,3-butanediol, diethylene glycol, 1,5-pentanediol, 1,6-hexanediol, neopentyl glycol, etc.; alicyclic alcohols such as cyclohexane dimethanol, hydrogenated bisphenol, etc.; and bisphenol derivatives such as bisphenol A-ethylene oxide addition product, bisphenol A-propylene oxide addition product, etc., can be used.

As the polyhydric carboxylic acid, aromatic carboxylic acids such as phthalic acid, terephthalic acid, phthalic anhydride, etc., and the acid anhydrides thereof; and saturated or unsaturated carboxylic acids such as succinic acid, adipic acid, sebacic acid, azelaic acid, dodecenylsuccinic acid, etc., and the acid anhydrides thereof can be used.

1.5 Particle size and particle size distribution of colored particles

It is preferred that the particle size of the colored particles is small and the particle distribution width thereof is narrow, because in this case, even when the concentrations of the pigments are increased, the fine-line reproducibility and the gradation reproducibility are improved. Also, because when the particle size of the colored particles is small, the toner particle amount (DMA: $mg/cm^2$) necessary for developing electrostatic latent images can be lowered by increasing the concentrations of the pigments, the toner layer in the imaged region can be thinned and a uniform solid black image having no luster unevenness in the image can be formed. On the other hand, when the particle size of the colored particles is large, there is a tendency that with the increase of the pigment concentrations in the colored particles, the graininess of the highlight portion of the image is lowered.

From such view points, the volume average particle size of the colored particles is in the range of preferably from 1.0 to 5.0 $\mu$m, more preferably from 2.0 to 5.0 $\mu$m, far more preferably from 2.0 to 4.5 $\mu$m, and particularly preferably from 2.0 to 4.0 $\mu$m. If the volume average particle size of the colored particles is not larger than 5.0 $\mu$m, because the ratio of coarse particles is less, the reproducibility of the fine-lines and fine-dots and the gradation reproducibility of the image obtained by a fixing step are improved. On the other hand, if the volume average particle size of the colored particles is shorter than 1.0 $\mu$m, the powder fluidity, the developing property, or the transferring property of the toner comprising such colored particles are reduced and it sometimes happens that various troubles occur in other steps accompanied by the lowering of the powder characteristics, such as lowering of the cleaning property of the toner remaining the surface the electrostatic latent image holder, etc. Accordingly, the volume average particle size of the colored particle is preferably in the above-described range.

In addition, the term "the reproducibility of fine line" in this invention means whether or not the fine line of a width of mainly from 30 to 60 $\mu$m, and preferably from 30 to 40 $\mu$m can be faithfully reproduced, and further takes into consideration of whether or not the dot of about the same size can be reproduced.

Furthermore, it is preferred that the colored particles have the particle size distribution that ratio of the colored particles having the particle sizes of not larger than 1.0 $\mu$m is 20% or less, and the ratio of the colored particles having particle sizes of 5 $\mu$m or larger is 10% or less. If the ratio of the colored particles of not larger than 1.0 $\mu$m in the whole colored particles exceeds 20%, a fog is liable to form at the non-imaged portions and the cleaning inferiority of a photoreceptor is liable to occur. Also, if the ratio of the colored of not larger than 1.0 $\mu$m exceeds 20%, the non-electrostatic attaching force of the toner becomes large, whereby there is a tendency that the toner fixes to the surface of a carrier, the charge imparting faculty by the carrier to the toner is lowered, and the resistance is increased, and as the result thereof, the image quality of the images obtained is lowered. From the view points of attaining a high image quality and keeping the high image quality, it is more preferred that the color particles have the particle size distribution that the ratio of the colored particles having the particles sizes of from 1.0 $\mu$m to 2.5 $\mu$m is from 5 to 50%, and it is far more preferred that the ratio of the above-described colored particles is from 10 to 45%.

Also, in the above description, as the parameter of defining the large particle side of the particle size distribution of the colored particles, the ratio (number %) of the colored particles exceeding 5.0 μm was used but the particle size as the standard can be defined by other numerical value. Practically, when the standard particle size is 4.0 μm, it is preferred that the ratio of the colored particles of not larger than 4.0 μm in the whole colored particles is at least 75%.

The colored p articles of such a particle size distribution can be produced by a production method which has hitherto been known. For example, in the case of obtaining by a grinding method, the conditions of grinding and classification may be properly established and in the case of obtaining by a polymerization method (a suspension polymerization method, an emulsion polymerization method, etc.), the granulation condition at polymerization may be properly established. In the grinding method described above, after preliminary mixing a binder resin, coloring agents, and, if necessary, other additive(s), the mixture is melt-kneaded by a kneading machine and after cooling, the kneaded mixture is ground and classified to obtain a desired particle size distribution.

Hitherto, when colored particles are small-sized in the grinding method, there sometimes occur the problems that a cost is increased by lowering of the grinding property, the classifying property is lowered by the reduction of the powder characteristics, etc. However, in the case of producing the colored particles used in this invention by the grinding method, when the grinding condition at grinding is properly selected and established, the colored particles having the particle size distribution near the above-described preferred particle size distribution range can be produced without accompanied by broadening of the particle size distribution by excessive grinding. Accordingly, thereafter, it is scarcely necessary to adjust the particle size distribution using a classifier or even of it is necessary to adjust the particle size distribution, the amount of the colored particles to be removed is very small, the production cost can be lowered.

The particle size distribution of the colored particles can be measured by various methods but the above-described preferred particle size distribution is the particle size distribution measured using a Coulter Counter Type TA2 (manufactured by Coulter Co.) with the aperture size of 50 μm, with the exception of measuring with the aperture size of 30 μm only when the particle size distribution of the colored particles of not larger than 1 μm are measured. Practically, the measurement of the particle size distribution is carried out by adding 2 or 3 drops of a dispersion (surface active agent: Triton X100) and the measuring sample (colored particles) to an aqueous solution of sodium chloride (10 g/liter) and after carrying out a dispersion treatment by a ultrasonic dispersing means for one minute, using the above-described apparatus.

1.6 Other additives

If necessary, the colored particles may contain a charge-controlling agent, a parting agent, etc., in the ranges of not giving influences on the color reproducibility, etc., of the black toner. The charge-controlling agent includes chromium-series azo dyes, iron-series azo dyes, aluminum-series azo dyes, salicylic acid metal complexes, organic boron compounds, etc. The parting agent includes polyolefins such as low-molecular weight polypropylene, low-molecular weight polyethylene, etc.; natural waxes such as a paraffin wax, a candelilla wax, a carnauba wax, montan wax, etc., and the derivatives thereof.

2. External additives

As the external additives used in this invention, inorganic fine powders can be suitably used. Examples of the inorganic fine powders include the fine powder of a metal oxide such as titanium oxide, tin oxide, zirconium oxide, tungsten oxide, iron oxide, silicon oxide, etc.; a nitride such as titanium nitride, etc.; and a titanium compound. The addition amount of the external additive is preferably from 0.05 to 10 parts by weight, and more preferably from 0.1 to 8 parts by weight to 100 parts by weight of the coloring particles.

In addition, a method of adding the inorganic fine powders to the toner, for example, a conventionally known method of placing the inorganic fine powders and the color particles in a Henschel mixer followed by mixing can be employed.

From a view point of improving the powder characteristics of the toner, such as the powder fluidity, the powder attaching property, etc., it is preferred to use at least one kind of super-fine particles having a primary particle mean particle size of 30 nm or larger but not larger than 200 nm and at least one kind of hyper-fine particles having a primary particle mean particle size of 5 nm or larger but shorter than 30 nm.

Super-fine particles have functions of reducing the adhesion of the colored particles each other and the colored particles and a photoreceptor or a carrier, and preventing lowering of the developing property, the transferring property, or the cleaning property. The mean primary particle size of the super-fine particles is 30 nm or larger but not larger than 200 nm, preferably 35 nm or larger but not larger than 150 nm, and more preferably 35 nm or larger but not larger than 100 nm. If the particle size thereof exceeds 200 nm, the super-fine particles are liable to be released from the toner and cannot give the effect of reducing the adhesion of the colored particles. On the other hand, of the particle size is shorter than 30 nm, the functions of the super-fine particles become the functions of the hyper-fine particles described below.

The hyper-fine particles have the functions of improving the fluidity of the colored particles, lowering the cohesiveness and also restraining the occurrence of the thermal cohesion of the colored particles, and also contributing to the improvement of the environmental safety. The mean primary particle size of the hyper-fine particles is 5 nm or larger but smaller than 30 nm, preferably 5 nm or larger but shorter than 29 nm, and more preferably 10 nm or larger but not larger than 29 nm. If the particle size thereof is shorter than 5 nm, the particles are liable to be embedded in the surface of the colored particles by the stress receiving by the toner. On the other hand, if the particle size thereof is 30 nm or larger, the functions thereof become the functions of the super-fine particles described above. In addition, the term "primary particle size" in the specification means the primary particle size of sphere-equivalent.

The super-fine particles include the fine particles of a metal oxide such as silicon oxide, titanium oxide, zirconium oxide, tungsten oxide, iron oxide, etc.; a nitride such as titanium nitride, etc., and a titanium compound and the super-fine particles of silicon oxide subjected to a hydrophobic treatment are preferred. The hydrophobic treatment is carried out by treating with a hydrophobic treating agent, and as the hydrophobic treating agent, chlorosilane, alkoxysilane, silazane, and silylated isocyanate can be used. Practical examples of the hydrophobic treating agent include methyltrichlorosilane, dimethyldichlorosilane, trimethylchlorosilane, methyltrimethoxy-silane, dimethyldimethoxysilane, methyltriethoxysilane, dimethyldiethoxysilane, isobutyltrimethoxysilane, decyltrimethoxysilane, hexamethyldisilazane, tert-butylmethylchlorosilane, vinyltrichlorosilane, vinyltrimethoxysilane, and vinyltriethoxysilane.

The hyper-fine particles include the fine particles of a hydrophobic titanium compound; a metal oxide such as silicon oxide, tin oxide, zirconium oxide, tungsten oxide, iron oxide, etc.; a nitride such as titanium nitride, etc., and in these particles, the fine particles of a hydrophobic titanium compound are preferred.

Also, as the fine particles of the hydrophobic titanium compound, the reaction product of metatitanic acid and a silane compound are preferred because they have a high hydrophobic property, are hard to form the aggregate thereof because of no burning treatment, are good in the dispersibility at adding as external additive. Also, as the silane compound for forming the titanium compound, an alkylalkoxysilane compound and/or a fluoroalkylalkoxysilane compound, which shows a good charge control of the toner and can reduce the adhesion of the carrier to a photoreceptor, is preferably used.

As the metatitanic acid compound which is the reaction product of metatitanic acid and an alkylalkoxysilane compound and/or a fluoroalkylalkoxysilane compound, the product obtained, after subjecting metatitanic acid synthesized by a sulfuric acid hydrolysis reaction to a flocculating treatment, by reacting titanic acid as the base and an alkylalkoxysilane compound and/or a fluoroalkylalkoxysilane compound can be suitably used. As the alkylalkoxysilane which is reacted with metatitanic acid, for example, methyltrimethoxysilane, ethyltrimethoxysilane, propyltrimethoxysilane, isobutyltrimethoxysilane, n-butyltrimethoxysilane, n-hexyltrimethoxysilane, n-octyltrimethoxysilane, and n-decyltrimethoxysilane can be used. Also, as the fluoroalkylalkoxysilane compound, for example, trifluoropropyltrimethoxysilane, tridecafluorooctyltrimethoxysilane, heptadecafluorodecyltrimethoxysilane, heptadecafluorodecylmethyldimethoxysilane, (tridecafluoro-1,1,2,2-tetrahydrooctyl)triethoxysilane, (3,3,3-trifluoropropyltrimethoxysilane, (heptadecafluoro-1,1,2,2,-tetrahydrodecyl)triethoxysilane, and 3-(heptafluoroisopropoxy)propyltriethoxysilane can be used.

By using the two kinds of the external additives of the super-fine particles and the hyper-fine particles, the toner has the effects of the addition of the two kinds of the particles together.

However, when the addition amount of the external additives is too much as a whole, free (not attached to the colored particles) external additives exist and the surfaces of a photoreceptor and a carrier are liable to be stained with the external additives. Also, if the addition amounts of the super-fine particles and the hyper-fine particles are less than a certain extent, the effects of adding both particles are not obtained. Furthermore, if the amount of the super-fine particles is too much, the effect of improving the powder fluidity is not obtained and if the amount of the hyper-fine particles is too much, the effect of improving the power attaching property is not obtained. Accordingly, it is necessary to properly control the addition amounts of the external additives.

The appearance of the effects by the addition of the external additives and the deviation of various powder characteristics described above do not depend upon the absolute amounts of the external additives added but depend upon the covering ratio of the external additives to the surface of the colored particles. Thus, the covering ratio of the external additives to the surface of the colored particles is explained below.

When the external additive is assumed to be a pearl having a definite size (diameter d) and it is assumed that primary particles causing no aggregation attach onto the surface of a colored particle as a single layer, the closest packing (most densely arranged state) of the external additives is the hexagonal closes packing wherein 6 external additives 22a to 22f are adjacent to one external additive 22 as shown in FIG. 1 (FIG. 1 is an enlarged plane view showing only a part of the surface of a colored particle).

When the state as shown in FIG. 1 is defined to be the covering ratio of 100%, the ratio of the actual weight of the external additives to the actual weight of the colored particles shown by % is defined to be the covering ratio in this invention.

That is, when, in the actual state, the volume mean particle size of the colored particles is D ($\mu$m), the true specific gravity of the colored particles is $\rho_t$, the primary particle me an particle size of the external additive is d ($\mu$m) the true specific gravity of the external additive is $\rho_a$, and the ratio (x/y) of the weight x (g) of the external additives to the weight y (g) of the colored particles is C, the covering ratio F (%) becomes as follows, $$F=C/\{2\pi\cdot d\cdot\rho_a/(\sqrt{3}\cdot D\cdot\rho_t)\}\times 100$$

and by arranging the formula, it becomes following formula (2);

$$F=\sqrt{3}\cdot D\cdot\rho_t\cdot(2\pi\cdot d\cdot\rho_a)^{-1}\cdot C\times 100 \quad (2)$$

(In the above formula, F represents a covering ratio (%), D the volume mean particle ratio ($\mu$m) of the colored particles), $\rho_t$ is the true specific gravity of the colored particles, d the primary mean particle size ($\mu$m) of the external additive, $\rho_a$ is the true specific gravity of the external additive, and C the ratio (x/y) of the weight (g) of the external additive to the weight (g) of the colored particles.)

It is preferred that the covering ratio of the external additives to the surface of the colored particles obtained by the formula (a) is at least 20% about each of the super-fine particles Fa and the hyper-fine particles Fb and also it is preferred that the sum total of the covering ratios of the whole external additives is not higher than 100%. In addition, the term "the sum total of the covering ratios of the whole external additives" means the sum total of the covering ratios of the external additives obtained by calculating the covering ratio of each external additive added.

If the covering ratio Fa of the super-fine particles is less than 20%, the effect by the addition of the super-fine particles is not sometimes obtained. The covering ratio Fa of the super-fine particles is preferably from 20 to 80%, and more preferably from 30 to 60%.

Also, if the covering ratio Fb of the hyper-fine particles is less than 20%, the effect by the addition of the hyper-fine particles is not sometimes obtained. The covering ratio Fb of the hyper-fine particles is preferably from 20 to 80%, and more preferably from 30 to 60%.

If the covering ratios of the whole external additives exceed 100%, many free external additives exist, whereby the surfaces of a photoreceptor and a carrier are liable to be stained with the free external additives. The sum total of the covering ratios of the whole external additives is preferably from 40 to 100%, and more preferably from 50 to 90%.

It is more preferred that the relation of the covering ratio Fa (%) of the super-fine particles and the covering ratio Fb (%) of the hyper-fine particles satisfies the following equation (3):

$$0.5\leqq Fb/Fa\leqq 4.0 \quad (3)$$

If the relation does not satisfy the equation (3), the effect to be brought by the addition of the super-fine particles or hyper-fine particles is hardly obtained and hence, such is not preferable. Also, in order to make the effect to be brought by the addition of the super-fine particles or hyper-fine particles optimum, it is most preferred that the following equation (3') is satisfied.

$$0.5 \leqq Fb/Fa \leqq 2.5 \quad (3')$$

As a method of adding the super-fine particles and the hyper-fine particles to the toner, for example, a conventionally known method of placing the super-fine particles, the hyper-fine particles, and the colored particles in a Henschel mixer followed by mixing can be employed.

The black toner of this invention is mixed with a carrier and the mixture is suitably used as a developer for electrostatic latent images.

There is no particular restriction on the carrier and as the carrier, there are resin-coated type carrier particles obtained by coating the surface of magnetic substance particles such as an iron powder, ferrite, an iron oxide powder, a nickel powder, etc., as the core material with a known resin such as a styrene-based resin, a vinyl-based resin, an ethyl-based resin, a rosin-based resin, a polyester-based resin, a methyl-based resin, etc., to form a resin-coated layer thereon and magnetic substance dispersed type carrier particles obtained by dispersing magnetic substance fine particles in a binder resin, etc.

In these carrier particles, the resin-coated type carrier particles having a resin coated layer are particularly preferred because the charging property of the toner and the resistance of the whole carriers can be controlled by the resin-coated layer.

The material of the resin-coated layer can be selected from all the resins which have hitherto been used as the materials of the resin-coated layers of carriers in the field of the art. Also, the resins can be used singly or as a mixture of two or more kinds.

The particle size of the carrier particles is preferably not larger than 45 μm, and more preferably from 10 to 40 μm as the volume mean particle size. By making the volume mean particle size of the carrier particles 45 μm or shorter, raising of the electrostatic charge by small-sizing of the toner (colored particles) and the occurrences of the background stain and the density unevenness caused by the reduction of the charging distribution and lowering of the charged amount can be improved.

Then, the following examples are intended to illustrate this invention in more detail but not to limit the invention in any way.

EXAMPLE 1

1) Preparation of magenta flashing pigment:

In a kneading machine were placed 70 parts by weight of a polyester resin (bisphenol A type polyester: bisphenol A-ethylene oxide adduct-cyclohexane dimethanol ether-terephthalic acid, weight average molecular weight: 11,000, number average molecular weight: 3,500, Tg: 65° C.) and 75 parts by weight of a hydrous paste (pigment component 40% by weight) of a magenta pigment (C.I. Pigment Red 57:1) followed by mixing, and the mixture was gradually heated. Kneading was continued at 120° C., after separating an aqueous phase from a resin phase, water was removed, furthermore, the resin phase was kneaded, and water was removed therefrom to obtain a magenta flashing pigment. The magenta flashing pigment was dispersed with a mean dispersed particle size of a circle-equivalent diameter of 0.3 μm.

2) Cyan flashing pigment:

By following the same procedure of obtaining the magenta flashing pigment except that a hydrous paste (pigment component 40% by weight) of a cyan pigment (C.I. Pigment Blue 15:3) was used in place of the hydrous paste of the magenta pigment, a cyan flashing pigment was prepared. The cyan flashing pigment was dispersed with a mean dispersed particle size of a circle-equivalent diameter of 0.3 μm.

3) Yellow flashing pigment:

By following the same procedure of obtaining the magenta flashing pigment except that a hydrous paste (pigment component 40% by weight) of a yellow pigment (C.I. Pigment Yellow 17) was used in place of the hydrous paste of the magenta pigment, a yellow flashing pigment was prepared. The yellow flashing pigment was dispersed with a mean dispersed particle size of a circle-equivalent diameter of 0.3 μm.

4) Preparation of colored particles (black):

Polyester resin (bisphenol A type polyester: bisphenol A-ethylene oxide adduct-cyclohexane dimethanol ether terephthalic acid, weight average molecular weight: 11,000, number average molecular weight: 3500, Tg: 65° C.) 64 weight parts Carbon black (mean particle size 10 nm) 6 weight parts The above-described cyan flashing pigment (pigment component 30 weight %) 10 weight parts The above-described magenta flashing pigment (pigment component 30 weight %) 10 weight parts The above-described yellow flashing pigment (pigment component 30 weight %) 10 weight parts The above-described components were melt-kneaded by a bambury mixer, and after cooling, fine-grinding by a jet mill and the classification by an air classifier were carried out to obtain black particles.

5) Preparation of black toner:

To above-described black particles were added silica ($SiO_2$) fine particles (super-fine particles) having a primary mean particle size of 40 nm subjected to a surface-hydrophobic treatment with hexamethyldisilazane (hereinafter, is sometimes referred to as "HMDS") and metatitanic acid compound fine particles (hyper-fine particles) having a primary mean particle size of 20 nm, which was a reaction product of metatitanic acid and isobutyltrimethoxysilane so that each covering ratio to the surface of the black particles became 40%, and the mixture was mixed by a Henschel mixer to prepare a black toner.

In addition, the covering ratio to the surface of the black particles described above is the value F (%) obtained by the above-described formula (2).

6) Preparation of carrier

To 100 parts by weight of Cu—Zn ferrite fine particles having a volume mean particle size of 40 μm was added a methanol solution containing 0.1 part by weight γ-aminopropylethoxysilane, after kneading the mixture by a kneader to coat the fine particles with the silane compound, methanol was distilled away and the residue was further heated to 120° C. for 2 hours to completely cure the silane compound. To the fine particles was added a solution of a perfluoro-octylethyl methacrylate-methyl methacrylate copolymer (copolymerization ratio 40:60) dissolved in toluene and using a vacuum type kneader, a resin-coated type carrier was produced such that the coated amount of the perfluorooctylethyl methacrylate-methyl methacrylate copolymer became 0.5% by weight.

7) Preparation of black developer:

By mixing 4 parts by weight of the black toner obtained and 100 parts by weight of the resin-coated type carrier obtained, a black electrostatic latent image developer was prepared.

EXAMPLE 2

The above-described polyester resin 75.62 weight parts

Carbon black (mean particle size 10 nm) 6 weight parts

The above-described cyan flashing pigment (pigment component 30% by weight) 6.7 weight parts The above-described magenta flashing pigment (pigment component 30% by weight) 6.7 weight parts The above-described yellow flashing pigment (pigment component 30% by weight) 5 weight parts The above-described components were melt-kneaded by a bambury mixer, and after cooling, fine-grinding by a jet mill and the classification by an air classifier were carried out to obtain black particles. Thereafter, using the external additives and the carrier as used in Example 1, by following the same procedure as in Example 1, a black electrostatic latent image developer was prepared.

EXAMPLE 3

The above-described polyester resin 76.5 weight parts

Carbon black (mean particle size 10 nm) 6 weight parts

The above-described cyan flashing pigment (pigment component 30% by weight) 6.7 weight parts The above-described magenta flashing pigment (pigment component 30% by weight) 8.3 weight parts The above-described yellow flashing pigment (pigment component 30% by weight) 5 weight parts The above-described components were melt-kneaded by a bambury mixer, and after cooling, fine-grinding by a jet mill and the classification by an air classifier were carried out to obtain black particles. Thereafter, using the external additives and the carrier as used in Example 1, by following the same procedure as in Example 1, a black electrostatic latent image developer was prepared.

EXAMPLE 4

The above-described polyester resin 49 weight parts

Carbon black (mean particle size 40 nm) 6 weight parts

The above-described cyan flashing pigment (pigment component 30% by weight) 15 weight parts The above-described magenta flashing pigment (pigment component 30% by weight) 15 weight parts The above-described yellow flashing pigment (pigment component 30% by weight) 15 weight parts The above-described components were melt-kneaded by a bambury mixer, and after cooling, fine-grinding by a jet mill and the classification by an air classifier were carried out to obtain black particles. Thereafter, using the external additives and the carrier as used in Example 1, by following the same procedure as in Example 1, a black electrostatic latent image developer was prepared.

COMPARATIVE EXAMPLE 1

The above-described polyester resin 88 weight parts

Carbon black (mean particle size 10 nm) 12 weight parts

The above-described components were melt-kneaded by a bambury mixer, and after cooling, fine-grinding by a jet mill and the classification by an air classifier were carried out to obtain black particles. Thereafter, using the external additives and the carrier as used in Example 1, following the same procedure as in Example 1, a black electrostatic latent image developer was prepared.

COMPARATIVE EXAMPLE 2

The above-described polyester resin 88 weight parts

Carbon black (mean particle size 40 nm) 12 weight parts

The above-described components were melt-kneaded by a bambury mixer, and after cooling, fine-grinding by a jet mill and the classification by an air classifier were carried out to obtain black particles. Thereafter, using the external additives and the carrier as used in Example 1, by following the same procedure as in Example 1, a black electrostatic latent image developer was prepared.

COMPARATIVE EXAMPLE 3

The above-described polyester resin 55 weight parts

The above-described cyan flashing pigment (pigment component 30% by weight) 15 weight parts The above-described magenta flashing pigment (pigment component 30% by weight) 15 weight parts The above-described yellow flashing pigment (pigment component 30% by weight) 15 weight parts The above-described components were melt-kneaded by a bambury mixer, and after cooling, fine-grinding by a jet mill and the classification by an air classifier were carried out to obtain black particles. Thereafter, using the external additives and the carrier as used in Example 1, by following the same procedure as in Example 1, a black electrostatic latent image developer was prepared.

COMPARATIVE EXAMPLE 4

The above-described polyester resin 82 weight parts

Carbon black (mean particle size 10 nm) 8 weight parts

The above-described cyan flashing pigment (pigment component 30% by weight) 10 weight parts The above-described components were melt-kneaded by a bambury mixer, and after cooling, fine-grinding by a jet mill and the classification by an air classifier were carried out to obtain black particles. Thereafter, using the external additives and the carrier as used in Example 1, by following the same procedure as in Example 1, a black electrostatic latent image developer was prepared.

The various characteristics of the black particles obtained in Example 1 to Example 4 and Comparative Example 1 to Comparative Example 4 described above are shown in Table 1 below.

TABLE 1

| | Volume mean particle size (μm) | Particle of > 5 μm (No. %) | Particles of < 1 μm (No. %) | Primary mean particle size of Carbon Black (nm) | Concentration of Carbon Black (wt. %) | Concentration of Cyan Pigment (wt. %) | Concentration of Magenta Pigment (wt. %) | Concentration of Yellow Pigment (wt. %) | Covering ratio of Super-fine Particle External Additive (%) | Covering ratio of Hyper-fine Particle External Additive (%) |
|---|---|---|---|---|---|---|---|---|---|---|
| Example 1 | 3.2 | 0.8 | 3.8 | 10 | 6 | 3 | 3 | 3 | 40 | 40 |
| Example 2 | 3.6 | 2.2 | 3.0 | 10 | 6 | 2 | 2 | 1.5 | 40 | 40 |
| Example 3 | 3.5 | 1.8 | 3.2 | 10 | 6 | 2 | 2.5 | 1.5 | 40 | 40 |
| Example 4 | 3.2 | 1.0 | 3.8 | 40 | 6 | 4.5 | 4.5 | 4.5 | 40 | 40 |
| Comparative Example 1 | 5.7 | 28.4 | — | 10 | 12 | 0 | 0 | 0 | 40 | 40 |
| Comparative Example 2 | 7.8 | 84.1 | — | 40 | 12 | 0 | 0 | 0 | 40 | 40 |
| Comparative Example 3 | 7.5 | 80.1 | — | — | 0 | 4.5 | 4.5 | 4.5 | 40 | 40 |
| Comparative Example 4 | 7.3 | 79.2 | — | 10 | 8 | 3 | 0 | 0 | 40 | 40 |

Using each of the black electrostatic latent image developers obtained, an image was formed on a coated paper ("FX J", manufactured by FUJI XEROX CO., LTD.) by a copying machine (modified machine of "A Color 935" manufactured by FUJI XEROX CO., LTD.) and following evaluations were carried out. The evaluation results are shown in Table 2 below. Also, the color tone of the solid black image formed using each black particles was visually evaluated and the results are shown in Table 2 together.

Measurement of TMA:

A solid black image having an area ratio of 100% was transferred onto a coated paper and the weight of the toner per unit area (TMA: mg/cm$^2$) of the image portion was measured. As the practical measurement method, an unfixed solid black image having an area of 10 cm$^2$ was formed on a coated paper, the coated paper having the image was weighed, then after removing the toner on the coated paper by air blowing, the weight of the coated paper only was measured, and from the difference in weight before and after removing the toner, TMA was calculated.

Image density:

A solid black image having an area ratio of 100% was formed and the image density of the image portion was measured using X-Rite 404 (manufactured by X-Rite Co.).

Image fog:

The presence or absence of the formation of an image fog was visually observed and it was evaluated by the following standards. In the evaluation, ○ was defined to be an allowable range.

○: An image fog did not form or formed to an extent of giving no problem for practical use.

x: An image for formed to an extent the stain of background could be visually recognized.

Evaluation test of fine-line reproducibility:

An image of fine line was formed on a photoreceptor so that the line width became 50 μm and the image was transferred onto a transfer material and fixed. The fixed image of the fine line on the transfer material was observed using VH-6200 Microscope (manufactured by Keyence Co.) at 175 magnifications. Practical evaluation standards were as follows. In the evaluation, ○ was defined to be an allowable range.

○: An edge portion disturbance of the fine line was scarcely observed.

Δ: An edge portion disturbance of the fine line formed to an extent of being recognizable.

x: The edge portion of the fine line was largely disturbed.

Evaluation test of gradation reproducibility:

Gradation images of the levels of image area ratios of 5%, 10%, 20%, 30%, 40%, 50%, 60%, 70%, 80%, 90%, and 100% were formed and by measuring each of the image densities was measured by X-Rite 404 (manufactured by X-Rite Co.), the gradient was decided. Also, using VH-6200 Microscope (manufactured by Keyence Co.), the above-described images having the image area ratios of 5% and 10% were observed at 175 magnifications and about the gradation reproducibility, a relative evaluation was carried out with a 175 line print as a standard as follows.

○: The gradation reproducibility was same as the 175 line print.

Δ: The gradation reproducibility was slightly inferior to the 175 line print.

x: The gradation reproducibility was largely inferior to the 175 line print.

Highlight portion graininess:

gradation images of the levels having the image area ratios of the gradation images of 5% and 10% were formed, the images obtained were visually observed, and about the graininess of the highlight portion, the relative evaluation with a 175 line print as the standard was carried out as follows. In this evaluation, ○ was defined to be an allowable range.

○: The highlight portion graininess was same as the 175 line print.

Δ: The highlight portion graininess was slightly inferior to the 175 line print.

x: The highlight portion graininess was largely inferior to the 175 line print.

Evaluation of image luster uniformity of solid black image:

About the image obtained, the difference in luster between the imaged portion and the non-imaged portion (coated paper) was visually observed and the relative evaluation with a 175 line print as the standard was carried out as follows. In the evaluation, ○ was defined to be an allowable range.

○: The luster was uniform same as the 175 print.

Δ: The luster was slightly nonuniform as compared with the 175 print.

x: The luster was greatly nonuniform as compared with the 175 print.

Evaluation of color rendering:

Using a spectrophotometer ("Colorpack System", manufactured by SHIMADZU CORPORATION), the color characteristics of a solid black image obtained under a sun light (C light source) and an incandescent lamp (A light source) with the light of from 380 nm to 700 nm as the standard light [the measurement of the color characteristics was carried out based on the color coordinates (L*, a*, b*)]. Under each light source, from a* and b*, X and Y were obtained and the color rendering was evaluated by the following standards.

$X=|a^*(\text{A light source})-a^*(\text{C light source})|$ $Y=|b^*(\text{A light source})-b^*(\text{C light source})|$ When $X \leqq 1.8$ and $Y \leqq 0.5$, the change of the viewing color by the change of the wavelength of the light source was scarcely observed and the gray balance was good. In Table 2, ○ showed the case that X and Y were in the above-described range.

TABLE 2

| | TMA (mg/cm$^2$) | Image density | Image fog | Fine-line reproducibility | Gradation reproducibility | Graininess of highlight portion | Uniformity of image | Color rendering | Evaluation of viewing color |
|---|---|---|---|---|---|---|---|---|---|
| Example 1 | 0.25 | 1.7 | ○ | ○ | ○ | ○ | ○ | ○ | Slightly greenish black |
| Example 2 | 0.30 | 1.8 | ○ | ○ | ○ | ○ | ○ | ○ | Black*) |
| Example 3 | 0.28 | 1.8 | ○ | ○ | ○ | ○ | ○ | ○ | Black*) |
| Example 4 | 0.23 | 1.8 | ○ | ○ | ○ | ○ | ○ | ○ | Slightly greenish black |
| Comparative Example 1 | 0.30 | 1.8 | X | Δ | Δ | Δ | Δ | ○ | Slightly reddish black |
| Comparative Example 2 | 0.30 | 1.7 | X | X | X | X | ○ | ○ | Slightly bluish black |
| Comparative Example 3 | 0.43 | 1.7 | ○ | X | ○ | X | Δ | X | Greenish black |
| Comparative Example 4 | 0.43 | 1.7 | ○ | X | X | X | Δ | ○ | Strongly bluish black |

*): Same as the black shown by the colored particles in the case of using carbon black of 40 nm.

From the result of Table 2, in the cases of Comparative Example 1 and Comparative Example 2, wherein the black toners were produced using carbon black only as the coloring agent, in order to for the image having the same image density as in Examples 1 to 4 by almost same amounts of TMA as in Examples 1 to 4, it was necessary to increase the content of carbon black and as the result thereof, an image fog formed by the charging inferiority, etc., of the toners. On the other hand, in the case of Comparative Example 3 wherein the black toner was prepared using the C, M, and Y pigments only as the coloring agents, the black image showed color rendering. Also, in Comparative Example 4, the toner contained a cyan pigment in addition to carbon black, but in this case, the image formed showed strong bluish black.

As described above in detail, according to the present invention, a toner having the charging property and physical properties suitable for the image formation and having a high black density can be provided. Also, a black toner having a high black density and showing no color rendering can be provided.

What is claimed is:

1. A black toner for developing electrostatic latent images comprising colored particles and external additives, said colored particles containing at least a binder resin, carbon black and plural color pigments, wherein the plural color pigments show a black color by combining them and comprise a cyan pigment, a magenta pigment, and a yellow pigment; and wherein the concentration of carbon black in the colored particles is not higher than 10% by weight.

2. A black toner for developing electrostatic latent images according to claim 1, wherein the concentration ($C_{CB}$ weight %) of carbon black, the concentration ($C_C$ weight %) of the cyan pigment, the concentration ($C_M$ weight %) of the magenta pigment, and the concentration ($C_Y$ weight %) of the yellow pigment in the colored particles satisfy the following relationship (1);

$$C_{CB} \geqq C_M \geqq C_C \geqq C_Y \quad (1).$$

3. A black toner for developing electrostatic latent images according to claim 1, wherein the concentration of carbon black in the colored particles is 2% by weight or higher but not higher than 10% by weight.

4. A black toner for developing electrostatic latent images according to claim 1, wherein the magenta pigment, the cyan pigment, and the yellow pigment are contained in the colored particles as dispersed particles and mean dispersed particle size of said dispersed particles is not larger than 0.3 μm as a circle-equivalent diameter.

5. A black toner for developing electrostatic latent images according to claim 1, wherein volume mean particle size of the colored particles is from 1.0 to 5.0 μm.

6. A black toner for developing electrostatic latent images according to claim 1, wherein volume mean particle size of the colored particles is from 1.0 to 5.0 μm, ratio of the colored particles of not larger than 1.0 μm is not more than 20%, and ratio of the colored particles exceeding 5.0 μm is not more than 10%.

7. A black toner for developing electrostatic latent images according to claim 1, wherein the carbon black has a mean particle size of from 10 to 50 nm.

8. A black toner for developing electrostatic latent images according to claim 1, wherein the binder resin has a glass transition point of from 50 to 80° C.

9. A black toner for developing electrostatic latent images according to claim 5, wherein the colored particles have a particle size distribution such that the ratio of the colored particles of not larger than 1.0 μm is not higher than 20% and the ratio of the colored particles of at least 5 μm is not higher than 10%.

10. A black toner for developing electrostatic latent images according to claim 5, wherein the colored particles have a particle size distribution such that the ratio of the colored particles of from 1.0 μm to 2.5 μm is from 5 to 50%.

11. A black toner for developing electrostatic latent images according to claim 1, wherein the concentration of carbon black in the colored particles is not higher than 8% by weight.

12. A black toner for developing electrostatic latent images according to claim 1, wherein the concentration of carbon black in the colored particles is at least 3% by weight but not higher than 10% by weight.

13. A black toner for developing electrostatic latent images according to claim 8, wherein the binder resin has a glass transition point of from 55 to 75° C.

* * * * *